US006177885B1

(12) United States Patent
Weil et al.

(10) Patent No.: US 6,177,885 B1
(45) Date of Patent: Jan. 23, 2001

(54) SYSTEM AND METHOD FOR DETECTING TRAFFIC ANOMALIES

(75) Inventors: Roark D. Weil, Olivette; Asdrubal Garcia-Ortiz, Chesterfield; John R. Wootton, St. Louis, all of MO (US)

(73) Assignee: Esco Electronics, Inc., St. Louis, MO (US)

( * ) Notice: Under 35 U.S.C. 154(b), the term of this patent shall be extended for 0 days.

(21) Appl. No.: 09/185,321

(22) Filed: Nov. 3, 1998

(51) Int. Cl.[7] ..... G08G 1/01

(52) U.S. Cl. ..... 340/933; 340/934; 340/937; 701/117; 701/118

(58) Field of Search ..... 340/933, 934, 340/937; 701/117, 118

(56) References Cited

U.S. PATENT DOCUMENTS

| | | | | |
|---|---|---|---|---|
| 4,847,772 | | 7/1989 | Michalopoulos et al. . | |
| 5,289,183 | * | 2/1994 | Hassett et al. | 340/905 |
| 5,317,311 | * | 5/1994 | Martell et al. | 340/905 |
| 5,444,442 | | 8/1995 | Sadakata et al. . | |
| 5,448,484 | * | 9/1995 | Bullock et al. | 701/117 |
| 5,459,665 | * | 10/1995 | Hikita et al. | 701/117 |
| 5,696,503 | * | 12/1997 | Nasburg | 340/933 |
| 5,801,943 | * | 9/1998 | Nasburg | 340/910 X |

FOREIGN PATENT DOCUMENTS

| | | |
|---|---|---|
| 0 501 193 | 2/1992 | (EP) . |
| 0 479 698 | 8/1992 | (EP) . |

OTHER PUBLICATIONS

Roark Weil, Asdrubal Garcia–Ortiz & John Wootton, "Detection of Traffic Anomalies Using Fuzzy Logic Based Techniques," Advanced Development Center, Systems & Electronics, Inc. (St. Louis, MO), vol.— (No.—), p. —,.

Roark Weil, JOhn Wootton & Asdrubal Garcia, "Traffic Incident Detection: Sensors and Algorithms," Adavanced Development Center, Systems & Electronics, Inc. (St. Louis, MO), vol.— (No.—), p.—,.

* cited by examiner

*Primary Examiner*—Daryl Pope
(74) *Attorney, Agent, or Firm*—Polster, Lieder, Woodruff & Lucchesi, L.C.

(57) ABSTRACT

A traffic incident detection system (10) includes both the collection and analysis of traffic data and employs a time-indexed traffic anomaly detection algorithm which partitions time into categories of "type of day," and "time of day". Using this partition, a fuzzy neuromorphic, unsupervised learning algorithm calibrates fuzzy sets as "normal" and "abnormal" for a plurality of traffic descriptors. Fuzzy composition techniques are used, on a per traffic lane basis, to combine multiple traffic descriptors in order to determine membership in a "normal" or "abnormal" lane status. Each lane status is then combined to determine the overall status of a road segment. Initial training of the algorithm occurs during the first few weeks after a sensor (12) is installed. On-line background training continues thereafter to continually tune and track seasonal changes affecting system performance.

62 Claims, 5 Drawing Sheets

1.DAY
| | | |
|---|---|---|
| SAT | HOLD | HOLD |
| FRI | WRPH | HOLD |
| THU | WRKD | ENDH |
| WED | WRKD | ENDH |
| TUE | WRKD | ENDH |
| MON | WRKD | ENDH |
| SUN | ENDH | ENDH |
4.STOM:NORM
2.STDYNORMSPEC 3.SYST:NORM
FIG. 6
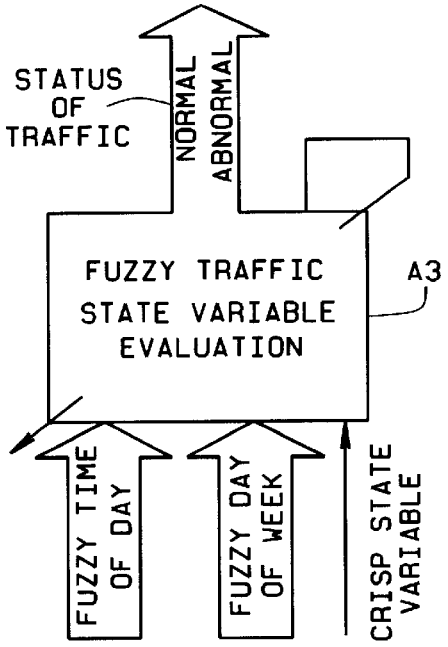
FIG. 7
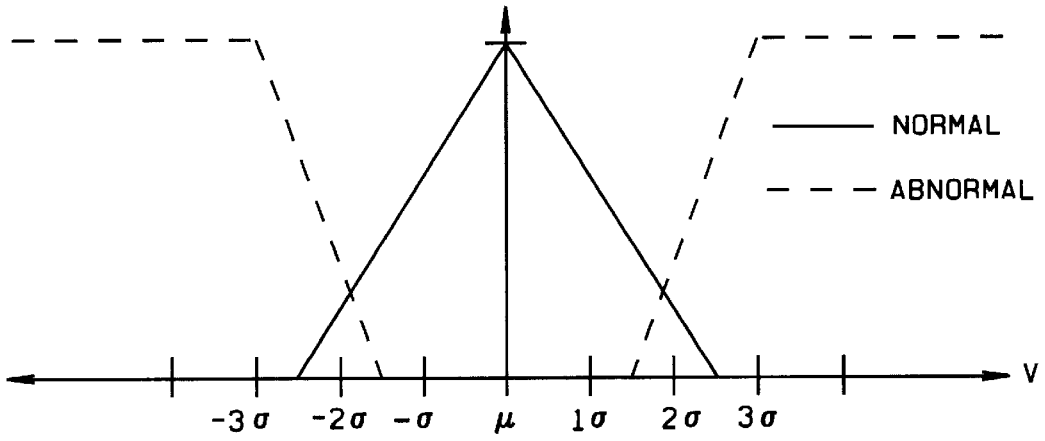
FIG. 8

SYSTEM AND METHOD FOR DETECTING TRAFFIC ANOMALIES

CROSS-REFERENCE TO RELATED APPLICATIONS

STATEMENT REGARDING FEDERALLY SPONSORED RESEARCH OR DEVELOPMENT

Not applicable.

BACKGROUND OF THE INVENTION

This invention relates to highway traffic incident detection, and more particularly, to a system and method for collecting and analyzing traffic data to detect incidents, the method including an algorithm incorporating neural networks and fuzzy logic techniques.

Probably the most important problem in urban freeway traffic operations is timely detection of unscheduled incidents such as accidents and vehicle breakdowns. An area wide system of strategically placed traffic sensors (e.g., video cameras) could be used to monitor traffic conditions. While humans can readily detect incidents, the work force required to completely monitor an urban road network rapidly becomes cost prohibitive. In place of extensive coverage requiring a large staff continuously watching TV monitors and monitoring data reports, many transportation departments rely on a relatively small number of "motoristaid" vehicles which roam critical highway segments around the network.

A major advantage of "motorist aid" methodologies is that a vehicle is on the spot, and for simple incidents (e.g., a vehicle out-of-fuel), immediate assistance can be rendered and the incident cleared away. Other times (e.g., an accident or mechanical breakdown), the aid vehicle operator can call for appropriate assistance. The major disadvantage of this approach is the geographic coverage required, and the chance the motorist aid vehicle is in the right place at the right time. This is a function of the number of aid vehicles deployed and the miles of road covered.

To insure the most efficient traffic flow possible for a given road network, the most important incidents to detect are those involving stopped vehicles. Rapid detection of these situations and early removal of the vehicles involved is most critical for efficient movement of traffic over the road system. A detection system which automatically detects highway incidents is thus an important need, and this has led the transportation industry to seek automatic incident detection mechanisms using data derived from measurements made by sensors deployed throughout the road system.

The process for determining the presence of an incident is two-fold. The first step is a determination of congestion. Next, an analysis of the congestion determines if its cause is an incident. All of the algorithms now in use are empirical, and most rely on the two variables, volume and occupancy. This is a historical preference since volume and occupancy are the measurements available from inductive loop sensors. There are basically two types of detection algorithms, viz:

(1) those that rely only on the measurement from one sensor station; and (2) those that use a comparison method of the readings from two sensor stations spatially separated along the highway.

The latter are known as comparative algorithms and generally expect (1) an increase in occupancy upstream of an incident (and where speed is used, a drop in vehicle speed); and (2) a drop in downstream occupancy together with an increase in vehicle speed.

Operating conditions, duration of the incident, detector spacing, and location of the incident are critical for comparative algorithms. Within the two types of algorithms, there are generally two classes of algorithms, those that use instantaneous measurements integrated over a short period of time (e.g. 30 seconds) and those that use a filter methodology, such as a recursive linear filter to in some way balance measurement uncertainty with the fundamental noise in the underlying generalized pattern flow assumptions.

The comparison method relies upon the ability of two detectors to communicate, which intrinsically increases cost of the system and reduces reliability. The prevailing wisdom is that the comparison method is better than a single station because of the latter's tendency to generate excessive false alarms.

The two main problems in developing a single station algorithm are:

(1) the complexity of distinguishing an incident from recurrent congestion; and (2) the difficulty of adjusting for incident related changes in traffic operation because of factors such as weather.

Progress has been made, however, in single station detectors because of the recognition that a single station detector is economically better, since it does not require continuous communication between two sensors. An example is the McMaster algorithm which uses flow and occupancy to determine the presence of an incident. This algorithm has been continuously improved and now includes a speed input when such is available from the detector.

Co-pending U.S. patent application Ser. No. 08/531,467 describes a non-imaging traffic sensor system which is useful in monitoring single lane traffic. Co-pending U.S. patent application Ser. No. 08/965,942 describes a video-based traffic sensor system which is useful in monitoring multiple lane traffic flow. These two sensors, like most state of the art sensors, provide not only volume and occupancy data but also speed, headway, and link travel time data. This invention exploits the added dimensionality of traffic flow parameters to more accurately detect the occurrence of traffic incidents.

BRIEF SUMMARY OF THE INVENTION

Among the several objects of the present invention may be noted the provision of a system for monitoring a road network and a methodology employing neuro-fuzzy logic techniques for determining when an incident has occurred somewhere on the network, so to facilitate prompt response to any incident and maintain as efficient a traffic flow as possible;

the provision of such a system used with current traffic sensors such as Insight™;

the provision of such a system in which the sensors "learn" and self-calibrate themselves in an unsupervised fashion, real-time, and in the field, this learning and self-calibration occurring both initially when a sensor is located in place, and thereafter;

the provision of such a system to employ a neural network for performing unsupervised learning about local traffic flow;

the provision of such a system in which the sensor makes a determination, in-situ, that a flow anomaly has occurred, and which reports the anomaly to a traffic control center, thereby to lessen the burden on a network monitoring staff by alerting them only when an incident is detected;

the provision of such a system to employ an algorithm utilizing derived traffic parameters in making an anomaly determination;

the provision of such a system in which parameters used by the algorithm may include parameters such as traffic volume, lane speed, lane occupancy, and/or vehicle headway;

the provision of such a system in which the algorithm further uses fuzzy logic in determining whether or not there is a traffic flow anomaly;

the provision of such a system in which the algorithm uses "day of the week" and "time of the day" in determining whether or not there is an anomaly;

the provision of such a system in which the above factors are seasonally dependent and the algorithm incorporates such dependence;

the provision of such a system in which the algorithm makes anomaly determinations on a lane by lane basis, as well as an overall road segment basis; and, the provision of such a system in which the algorithm associates, with each day of the week in a which a holiday or other special event occasion occurs, a degree of specialness that takes into account the impact of the holiday or special event on normal traffic flow.

In accordance with the invention, generally stated, a traffic monitoring system detects traffic incidents using a sensor such as a video camera to obtain traffic flow data including, for example, traffic volume, speed, lane occupancy, vehicle headway. This data is obtained for a roadway or an individual lane. The algorithm employs this data to determine, in conjunction with an established set of evaluation criteria, if traffic conditions on the roadway, at any given time, are normal or abnormal. An abnormal condition signifies that a traffic incident such as an accident or breakdown has occurred on or near the segment of roadway being monitored. Abnormal conditions are reported to a base station, together with video imagery and/or pertinent traffic data, for the abnormality to be investigated and any incident cleared. A method of detecting traffic incidents is also disclosed. Other objects and features will be in part apparent and in part pointed out hereinafter.

BRIEF DESCRIPTION OF THE SEVERAL VIEWS OF THE DRAWINGS

In the drawings.

FIG. 6 is a sample listing of fuzzy logic rules for the day of the week;

FIG. 7 represents a self learning block for a traffic parameter processed by one portion of the system;

FIG. 8 is a chart illustrating a membership functions for a particular traffic parameter at a particular fuzzy time of day and fuzzy day of the week; and, FIG. 9 is a block diagram of the system.

Corresponding reference characters indicate corresponding parts throughout the drawings.

DETAILED DESCRIPTION OF THE INVENTION

Figure 1:
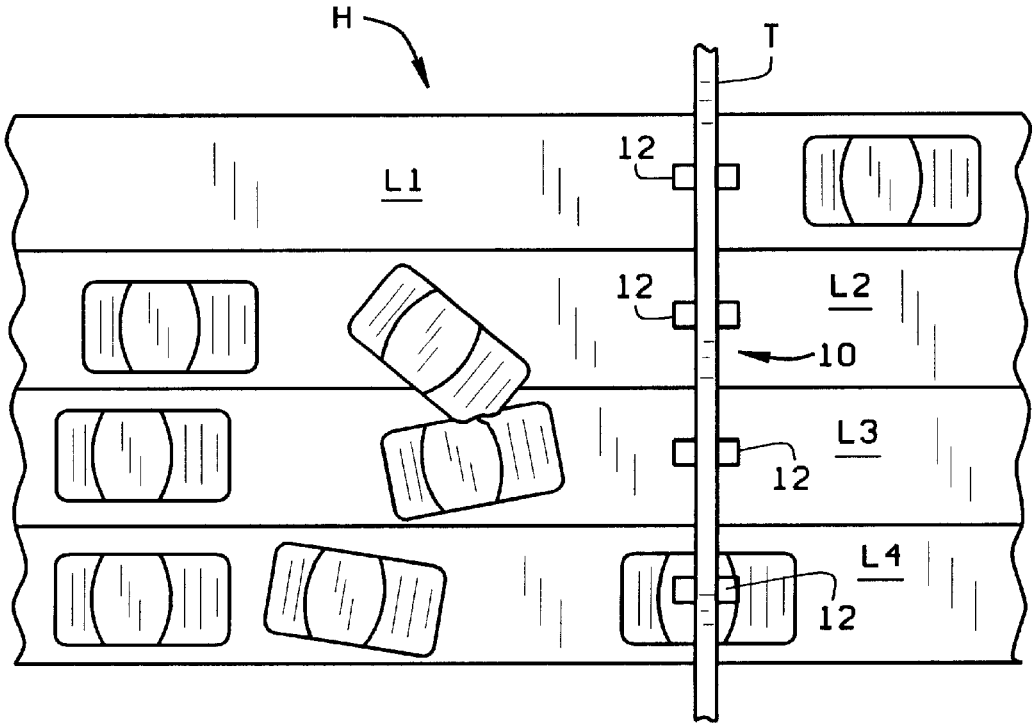
FIG. 1 is a block diagram representing a road segment monitored by a sensor of the system of the present invention to detect traffic anomalies occurring in each lane monitored and the overall road segment.
Figure 2:
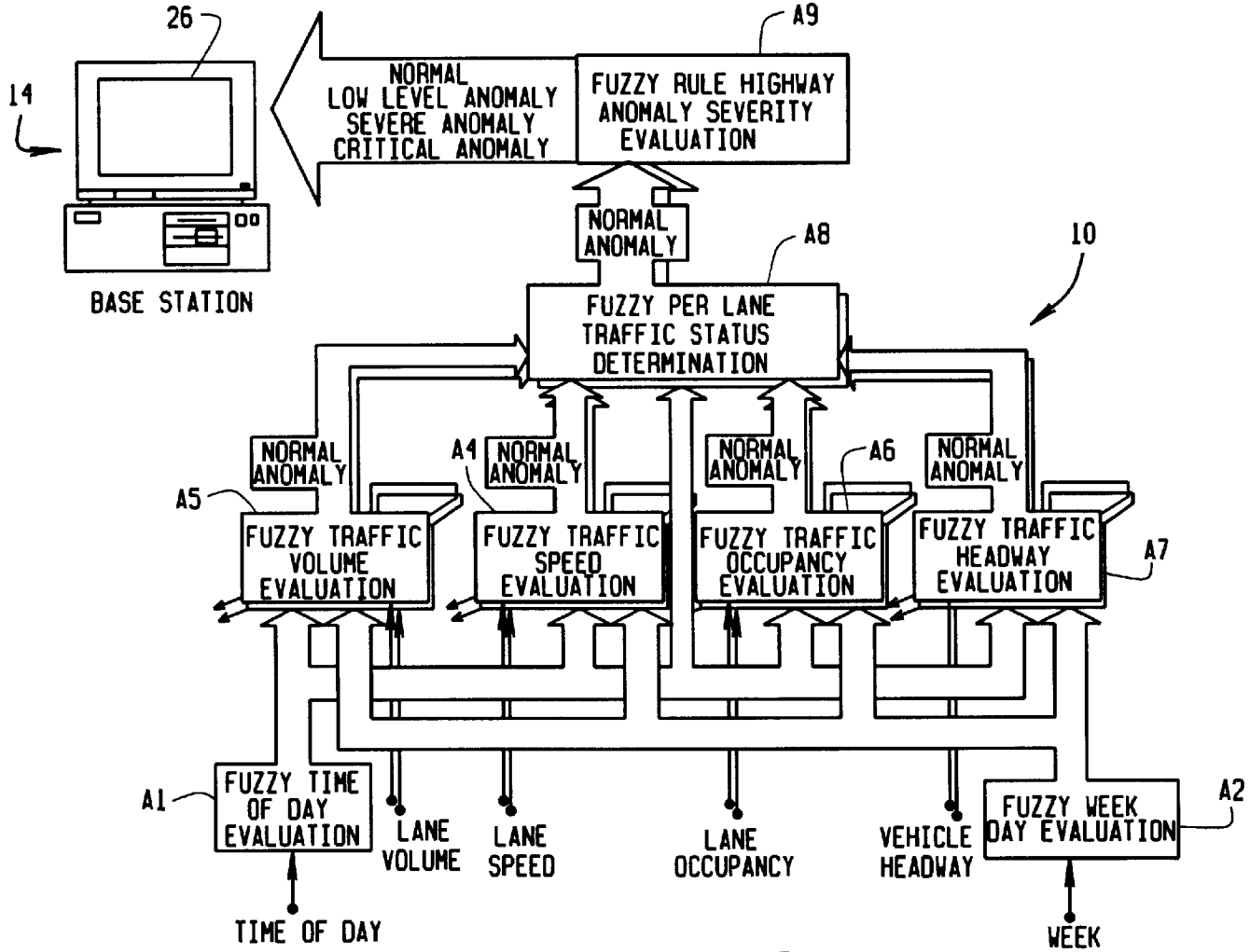
FIG. 2 is a flow diagram for the algorithm used in the traffic anomaly detection system.
Figure 9:
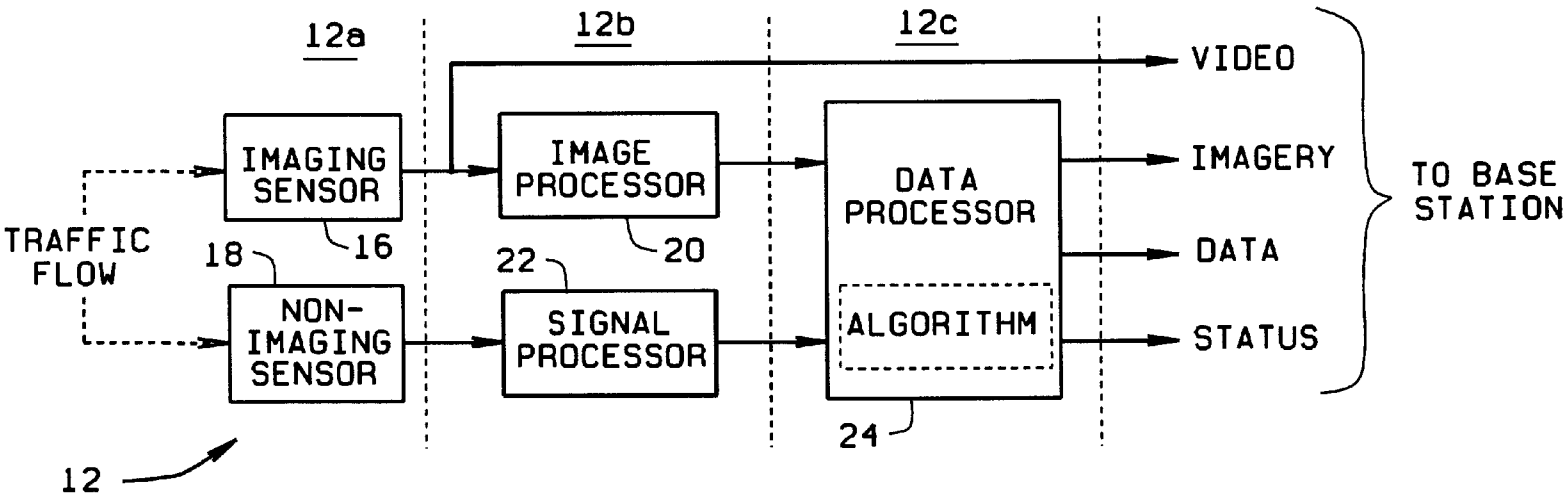

Referring to the drawings, a system for detecting traffic anomalies is indicated 10 in FIGS. 1 and 2. System 10 which, as described hereinafter, automatically detects traffic incidents such as accidents, or vehicles which are out of gas or have suffered mechanical breakdowns, can be used as an adjunct to traffic monitoring sensors such as the INSIGHT™ traffic monitoring sensor which is manufactured and sold by the assignee of the present application. The system includes at least one sensor 12 which monitors one or more lanes L of a highway segment H it being understood that there may be a sensor for monitoring each lane of traffic. The sensor or sensors are mounted, for example, over the roadway on a support T. Each sensor employed obtains a measurement of the lane or lanes it monitors, and processes this data in accordance with an algorithm (described hereinafter) to determine if traffic on the lanes, and on the overall highway segment, are normal or abnormal. Normalcy or abnormality is, in turn, dependent upon a number of factors. As a result, traffic on one lane (lane L1, for example) may be normal; while that on other lanes (lanes L2–L4) and the overall highway segment may be abnormal. The information developed by the sensors is supplied to a base station 14 of the system for viewing by a traffic controller or the like who can send appropriate aid to a site of abnormality. As shown in FIG. 9, each sensor 12 first includes an acquisition section 12*a* which can include either an imaging sensor 16 or a non-imaging sensor 18. Next, the sensor includes a processing section 12*b*. If the sensor is an imaging sensor such as a CCD video camera, or an infrared (IR) video camera, then section 12*b* includes an image processor 20. However, if the sensor is a non-imaging sensor such as a photo detector, microwave sensor, IR sensor, or acoustic sensor, then section 12*b* includes a signal processor 22. Each sensor, whether imaging or non-imaging may have a separate processor associated with it. Finally, the sensor includes a data processing section 12*c* including a data processor 24 which can process both image data and signal data. The algorithm is incorporated in processor 24 which can be a general purpose processor as well as a digital sequence processor. The output from sensor 12 includes video from imaging sensor 16, and imagery, data, and roadway status information from processor 24. Traffic flow parameters are updated every time a vehicle passes a sensor. The flow parameter values are integrated over time to generate a time-dependent measure of traffic flow for each parameter.

The importance of system 10 is its ability to detect incidents reliably, rapidly, and with a low false alarm rate. System 10 uses highway parameters of lane speed, volume, occupancy, density, link travel time, and headway to ascertain the presence of traffic flow pattern anomalies, recognizing that traffic patterns are not static but differ from one time period to another. Because a traffic incident or flow anomaly is defined as a situation differing "significantly" from normal flow, it is important to determine what normal flow is, as well those attributes which define normal flow.

Every road segment H has a unique level of traffic normality. Furthermore, this level of normality varies, hourly, daily, monthly, and seasonally, and includes congested traffic flow. Thus, at each sensor location, the sensor 12 must be uniquely calibrated. Since a traffic management system will comprise a large number of sensors, it is impractical to manually calibrate each sensor because of the time and cost involved. Yet such calibration does take place in field systems. One example is incident detection based upon the McMaster algorithm which requires that a linear decision boundary be defined by the user before the system is placed in operation. Because the boundary is "fixed", the system cannot adjust to the dynamics of the roadway. This, in turn, leads to degraded performance.

Figure 3:
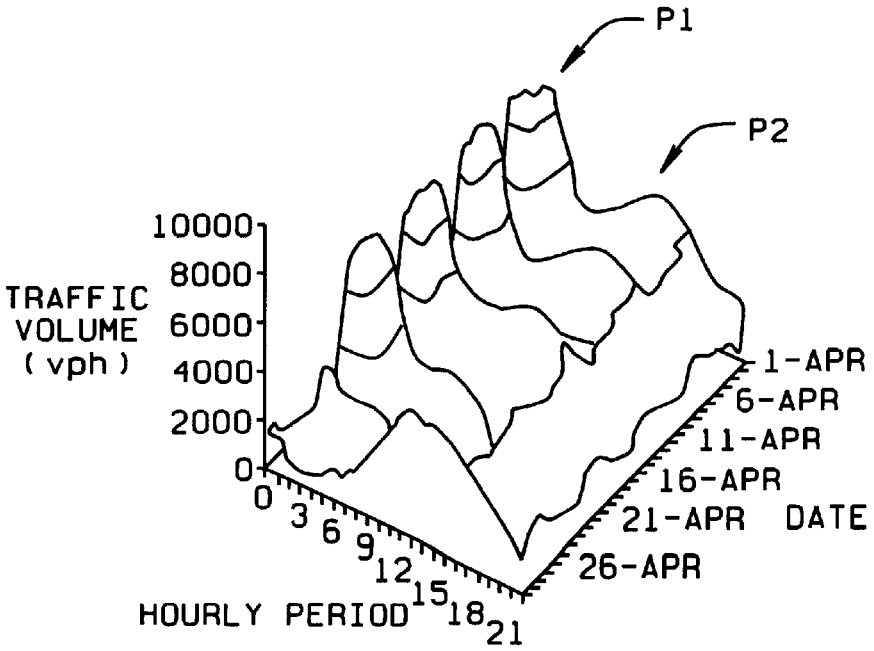
FIG. 3 is a chart representing the traffic volume pattern at a particular location in a road network.

A primary advantage of the present invention, therefore, is that the sensors 12 are able to self-calibrate themselves ("learn") in an unsupervised fashion, in real-time, and in the field. Self calibration is not a trivial task. FIG. 3 is a 3-dimensional plot of four weeks of traffic flow measured at a particular road location. One axis of the plot is the particular date, a second axis hourly periods within a day, and the third axis traffic volume in vehicles per hour (vph). The FIG. shows the temporal variations in traffic flow patterns. That is, for certain periods of time during each day of the week, there is more volume of traffic than at other times of the day. Clear, repeating patterns occur on both the Date and Hourly Period axes of FIG. 3. Two peaks (P1 and P2) are evident which correspond to the morning (P1) and evening (P2) rush traffic periods. Also as shown, weekends differ significantly from workdays. Thus, from observing the patterns in FIG. 3, it can be seen that there is a weekly and daily cycle of traffic flow, with minor variations. Though FIG. 3 indicates there is clearly a pattern to describing normal traffic, there are two key problems.

The first problem is the ability to screen the data, separating it into normal and anomalous condition data. It will be understood that collected raw data contains both types of observations and they are randomly mixed together. The other problem pertains to flow variations. There are both natural flow variations, and variations caused by anomalies. Seasonal changes, holidays, special events such as baseball games, even weather, affects normal flow patterns; and as such, should be accounted for in an incident detection algorithm. Therefore, the algorithm incorporated in system 10 is not only time dependent, but also has the ability to account for special events.

Unlike all other incident detection algorithms which collect sensor data at a traffic control center and then determine if there is an incident, the method of the present invention is for a sensor 12 to make the determination, in-situ, that a flow anomaly has occurred. The anomaly is then reported to base station 14. The overall algorithm structure for detecting traffic anomalies is shown in FIG. 2. The measured and derived traffic parameters used by the algorithm are traffic volume, lane speed, lane occupancy, and vehicle headway. The day of the week and the time of the day are also used by the algorithm. Data analysis is done on a per lane basis. Results are first generated for each lane of traffic, and then collectively for the overall road segment.

In developing the algorithm, certain features derived from an inspection of FIG. 3 are utilized. For example, time is partitioned into two areas for evaluation; a fuzzy Time of Day, and a fuzzy Day of the Week. While it may seem that a weekday would have crisp demarcations, it is nonetheless necessary to allow for holidays and special events that fall on a weekday, and have varying degrees of impact on traffic flow. For example, the effect of New Year's Day on traffic flow patterns is significantly different than that of Presidents' Day.

Figure 4:
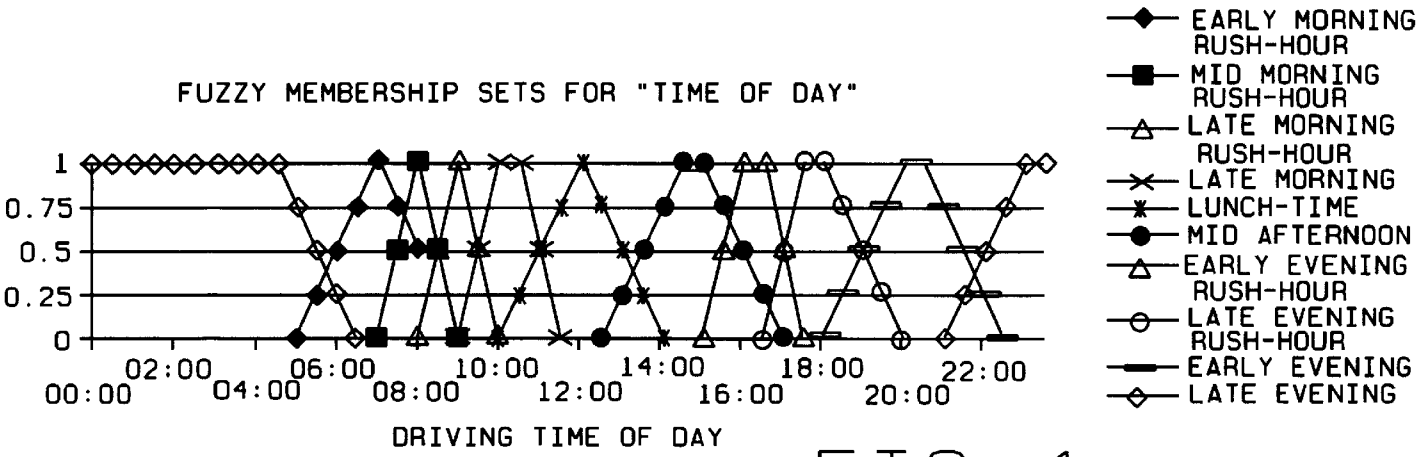
FIG. 4 is a graph of fuzzy membership sets for the time of day portion of the system.

As shown in FIG. 2, the algorithm includes a Fuzzy Time of Day Evaluation module A1. The time of day elements considered here are indicated in FIG. 4 and for each twenty-four hour period beginning at 00:00 include: Early Morning, Early Morning Rush, Mid-Morning Rush, Late Morning Rush, Late Morning, Lunch Time, Mid Afternoon, Early Evening, Early Evening Rush, Late Evening Rush and Late Evening. A membership value is associated with each of these elements as shown in FIG. 4 at the left of the Fig. These membership values were chosen "a priori" based upon the insight afforded by a study of the data in FIG. 3 and the inventors' best judgment. For any given time period of the day, a vector of dimension 11 is defined which indicates the membership for that time period in corresponding Fuzzy Time Of Day values. As seen from FIG. 4, only a few entries in the vector have a non-zero value.

As indicated at module A2 in FIG. 2, Day Of Week values are also incorporated in the algorithm. Four fuzzy values are included in the Day of the Week. These are Work Day, Work Day Preceding Holiday, Holiday and End of Holiday. In a normal week, Monday, Tuesday, Wednesday and Thursday are considered a Work Day. Friday is a Work Day Preceding Holiday. Saturday is a Holiday. Sunday is an End of a Holiday. When the workweek contains a special day, Thanksgiving Day, Presidents' Day, and Martin Luther King's Birthday, etc., the algorithm takes this event into account. In particular, for these occasions, the algorithm associates with each weekday a degree of specialness, ranging from 0 to 5, that describes the impact of the holiday on the normal traffic flow. A value of 0 indicates a minimally observed holiday with normal traffic flow. An example of this is United Nations Day. A value of 5 indicates a fully observed holiday with reduced traffic flow. An example of this is New Year's Day.

Figure 5:
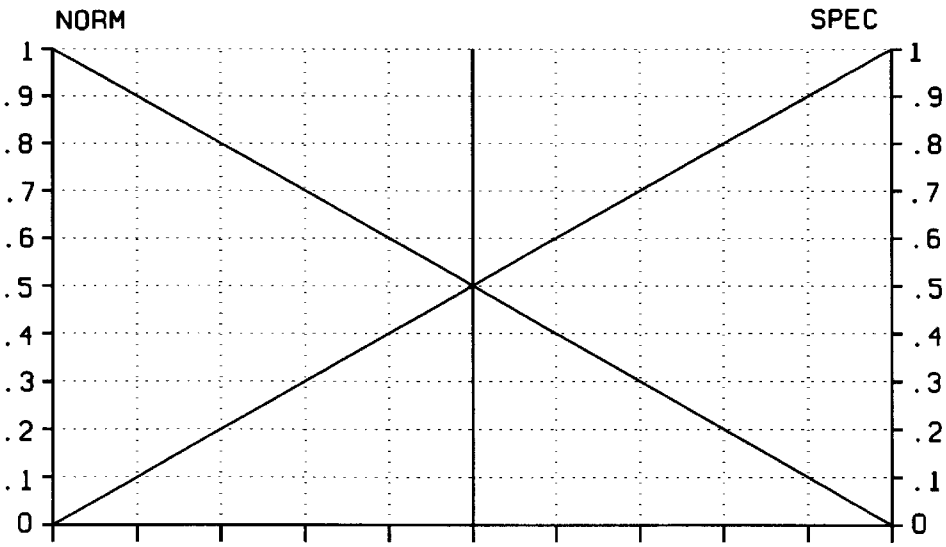
FIG. 5 is a chart illustrating fuzzy membership for the specialness of the day.

A fuzzy variable named Specialness of Day is associated with each day of the week, and this variable has the fuzzy values Normal and Special. The membership functions associated with these are shown in FIG. 5. To determine the Day of the Week, the crisp value Week Day and the Specialness of Day for yesterday, today, and tomorrow are combined using a fuzzy rule base. A portion of the rule base used in the algorithm is shown in FIG. 6. In FIG. 6, Week Day is shown at the left of the matrix, The Specialness of Day for today (STDY) is shown at the bottom. The specialness of Day for tomorrow (STOM) and for yesterday (SYST) are held constant at a value of Normal (NORM). The matrix entries in FIG. 6 illustrate the mapping of Week Day and Specialness of Day to Day of the Week, i.e., Work Day (WRKD), Work Day Preceding Holiday (WRPH), Holiday (HOLD), and End of Holiday (ENDH). The output of the rule base for each day is a vector of dimension 4 that indicates the Day of The Week.

Next, the method of the present invention includes evaluation of traffic data for a given type of day and the time period of the day. All traffic parameters are processed in a similar manner, and processing can be understood with reference to the generic, self-learning module A3 shown in FIG. 7 and labeled Fuzzy Traffic State Variable Evaluation. Inputs to this module include the two vectors described earlier for fuzzy Time of Day and fuzzy Day of The Week, as well as the crisp value of the traffic parameter to be evaluated. The output of module A3 is a status of the traffic parameter and can take the fuzzy values Normal and Abnormal. An important feature of module A3 is its ability to self-calibrate, or learn, in an unsupervised fashion. The learning mechanism consists of the Cartesian product of 11×4 processing element pairs ($\mu_{ij}$, $\sigma_{ij}$). These correspond to each possible pair of fuzzy values for fuzzy Time of Day and fuzzy Day of The Week.

Each processing element is updated whenever a new data input occurs according to the following equations:

$$\mu_{i,j}^{n+1} = e^{-cT_i^n D_j^n}\mu_{i,j}^n + \left(1 - e^{-cT_i^n D_j^n}\right)V^n, \text{ and}$$

$$\sigma_{i,j}^{2n+1} = e^{-dT_i^n D_j^n}\sigma_{i,j}^{2n+1} + \left(1 - e^{-dT_i^n D_j^n}\right)(V^n - \mu_{i,j}^n)^2$$

where i ϵ Time of Day j ϵ Day of The Week $V^n$ is the crisp input value at observation n, $T^n_i$ is the membership of the Time of Day in fuzzy value i at observation n, and $D^n_j$ is the membership of the Day of The Week in fuzzy value j at observation n.

The constants c and d represent learning rates and are chosen to control the classical time constant when both fuzzy values have a membership of 1.

It should be noted that if either $T^n_i$ or $D^n_j$ are equal to zero, then no learning takes place, i.e., $$\mu_{ij}^{n+1}=\mu_{ij}^{n},$$

and $$\sigma_{ij}^{n+1}=\sigma_{ij}^{n}.$$

Those skilled in the art will appreciate that since the methodology involves computing fuzzy statistics, the presence of anomalous data will have little impact so long as the learning rates c and d are properly selected.

Within each processing element, $\mu_{ij}$, and $\sigma_{ij}$ are used to form membership functions $N_{ij}(V)$ and $A_{ij}(V)$ for the fuzzy values Normal and Abnormal respectively, as shown in FIG. 8. In the drawing, superscripts and subscripts have been deleted for the sake of drawing clarity. Using FIG. 8, it can now be determined, on a temporal basis, the membership in Normal and Abnormal for any fuzzy time. For example, 55 mph can be determined to be a Normal speed during Early Morning hours on a Workday.

Next, an overall fuzzy Normal or Abnormal is computed for the traffic variable. This is done using the equations $$N_k(V^n) = \frac{\sum_{ij} T_i^n N_{ij}(V^n) D_j^n}{\left(\sum_i T_i^n\right)\left(\sum_j D_j^n\right)}$$

and $$A_k(V^n) = \frac{\sum_{ij} T_i^n A_{ij}(V^n) D_j^n}{\left(\sum_i T_i^n\right)\left(\sum_j D_j^n\right)}$$

where K ϵ {traffic variables}.

Referring again to FIG. 2, system 10, as noted, uses attributes of lane speed, volume, occupancy, and headway in the evaluation performed by the algorithm. Modules A4, A5, A6 and A7 respectively use this information in combination with inputs from both modules A1 and A2. The algorithm also includes a Fuzzy Per Lane Traffic Status Determination module A8. Module A8 composes, for each lane of traffic, membership functions $N^n$ and $A^n$, using individual traffic parameter membership functions $N_k(V^n)$ and $A_k(V^n)$. The output of module A8 to module A9 is a fuzzy variable Lane Status which has values Normal and Abnormal. In accordance with the invention, a traffic lane is defined as Normal only if all its traffic parameters are Normal. Therefore, it follows that $$N^n=\text{Min}(N_k(V_n):k\epsilon\{\textit{traffic variables}\}.$$

Likewise, a lane is defined as Abnormal whenever any one of its traffic parameters is Abnormal. Thus, $$A^n=\text{Max}(N_k(V_n):k\epsilon\{\textit{traffic variables}\}.$$

Module A9 combines the Lane Status reported by module A8 for each traffic lane L of road segment H, and provides as an output a Highway Status. Highway Status is a fuzzy variable having values of Normal, Low Level Anomaly, Severe Anomaly, and Critical Anomaly. The output of module A9 is sent over a communication channel to base station 14. If an abnormal traffic condition is detected, then an indication of this is transmitted to the base station. In addition to transmitting an image of the roadway, an alarm, such as an audible or visual alarm, is sent.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A traffic monitoring system monitoring traffic flow on a specific roadway section comprising:

an active fixed position sensor obtaining measurements of passive, non-sensor bearing-vehicles moving over a roadway; and, a processor co-located with said sensor and processing said measurements in accordance with an algorithm which takes into account traffic volume, traffic speed, roadway occupancy, and vehicle headway to determine, in accordance with an established set of temporal and spatial evaluation criteria if the traffic condition on the roadway, at any given time, is normal or abnormal, an abnormal condition signifying a traffic incident has occurred, said algorithm employing fuzzy logic to determine whether or not traffic conditions are normal or abnormal, the fuzzy logic employed evaluating at least the day of the week, the time of the day, the season of the year, and the specialness, if any, of the day, the preceding day, or the following day.

2. The system of claim 1 further including a base station to which an abnormal roadway condition is reported by said processor for said abnormality to be investigated.

3. The system of claim 1 wherein said roadway includes a plurality of traffic lanes each of which is observed by said sensor, and said processor makes a separate evaluation as to the normal or abnormal condition of each lane as well as the condition of the entire segment of roadway observable by said sensor.

4. The system of claim 3 further including a plurality of sensors, one for each lane of said roadway.

5. The system of claim 1 wherein said algorithm further takes into account the time of day and day of the week at which traffic is being observed including special event days.

6. The system of claim 1 wherein said sensor is a non-imaging sensor.

7. The system of claim 1 wherein said sensor is an imaging sensor.

8. A method of detecting traffic incidents occurring on a roadway comprising:

sensing the presence and movement of passive, non-signal-transmitting vehicular traffic moving over the roadway, the presence and movement being treated as data; and, processing said data in-situ to determine if traffic conditions on the roadway are normal or abnormal, processing a measurement including evaluating a local traffic related factor in conjunction with at least one time factor, and further in accordance with an established set of evaluation criteria as a result of which an a-priori traffic related factor which is present at one time may indicate traffic conditions on the roadway are normal, but at another time abnormal, an abnormal condition signifying a traffic incident has occurred, said processing including the use of fuzzy logic to determine whether or not traffic conditions are normal or abnormal, the fuzzy logic employed evaluating at least the day of the week, the time of the day, the season of the year, and the specialness, if any, of the day, the preceding day, or the following day.

9. The method of claim 8 further including notifying a base station if an abnormal condition is determined for said condition to be investigated.

10. The method of claim 8 wherein processing said measurements includes employing an algorithm which takes into account local traffic flow over the roadway.

11. The method of claim 10 wherein said algorithm further takes into account one or more of the following factors: traffic speed, roadway occupancy, and vehicle headway.

12. The method of claim 10 wherein said roadway has a plurality of traffic lanes and said algorithm separately evaluates the traffic on each lane and determines if the traffic is normal or abnormal.

13. The method of claim 12 wherein said algorithm makes an overall determination as to whether the traffic flow over the segment of roadway for which measurements are obtained is normal or abnormal based upon the various factors.

14. A method of evaluating a segment of roadway and traffic moving thereover to determine if traffic flow over the roadway is normal, or if an incident affecting traffic flow has occurred, comprising:

obtaining an image of the roadway segment and the traffic moving thereover;

processing said image in-situ and deriving therefrom at least one factor relating to movement of traffic over the roadway;

classifying the time at which the image is obtained in accordance with a predetermined set of criteria; and evaluating said traffic factor in conjunction with said time classification to determine if traffic conditions are normal or abnormal, an abnormal determination signifying a traffic incident has occurred, evaluating said traffic factor including the use of fuzzy logic to determine whether or not traffic conditions are normal or abnormal, the fuzzy logic employed evaluating at least the day of the week, the time of the day, the season of the year, and the specialness, if any, of the day, the preceding day, or the following day.

15. The method of claim 14 wherein said traffic factor includes at least one of the following: traffic volume, traffic speed, traffic occupancy of the roadway, and traffic headway.

16. The method of claim 15 wherein both said time of day and said day of week classifications are separately combined with a traffic factor in making said determination.

17. The method of claim 16 wherein a separate evaluation is made for each of said traffic factors and said evaluations are then combined to form an overall traffic evaluation.

18. The method of claim 17 wherein each separate factor evaluation is classified as either normal or abnormal and the overall traffic evaluation is normal if all of the separate factor evaluations are normal, but abnormal if any one of the separate factor evaluations is abnormal.

19. The method of claim 18 wherein said roadway includes a plurality of traffic lanes and a separate evaluation, including both of the time classifications and all of the aforesaid traffic factors, is made for each lane.

20. The method of claim 19 including providing a traffic incident indication to a base station if an abnormal condition is signified.

21. The method of claim 20 including providing video images of the roadway to the base station together with the abnormal indication.

22. A system for detecting road traffic flow anomalies comprising:

an active, fixed position sensor mounted as to sense the presence and movement of passive, non-sensor-bearing vehicles and collecting this information as data;

a processor, co-located with said sensor, for computing traffic flow parameter values from traffic flow data; and, a method for categorizing traffic flow from said traffic flow parameter values, said method including the use of fuzzy logic to determine whether or not traffic conditions are normal or abnormal, the fuzzy logic employed evaluating at least the day of the week, the time of the day, the season of the year, and the specialness, if any, of the day, the preceding day, or the following day.

23. The system of claim 22 wherein said sensor is an imaging sensor.

24. The system of claim 23 wherein said imaging sensor is a CCD video camera.

25. The system of claim 23 wherein said sensor is an infrared video camera.

26. The system of claim 22 wherein said sensor is a non-imaging sensor.

27. The system of claim 26 wherein said non-imaging sensor is a photo detector.

28. The system of claim 26 wherein said non-imaging sensor is a microwave sensor.

29. The system of claim 26 wherein said non-imaging sensor is an infrared sensor.

30. The system of claim 26 wherein said non-imaging sensor is an acoustic sensor.

31. The system of claim 22 wherein said sensor provides coverage for a single lane of traffic.

32. The system of claim 31 wherein including a plurality of sensors, one for each lane of traffic.

33. The system of claim 32 further including a plurality of processors, one for each said sensor, and used to compute the traffic flow parameters of the lane covered by said sensor.

34. The system of claim 22 wherein said sensor provides coverage for a plurality of traffic lanes on said road.

35. The system of claim 22 wherein said processor is a general purpose processor.

36. The system of claim 22 wherein said processor is a digital signal processor.

37. The system of claim 22 wherein said traffic flow parameters include volume, speed, density, occupancy, link travel time, and headway.

38. The system of claim 37 wherein said traffic flow parameter values are determined for each lane of traffic covered by said sensor.

39. The system of claim 38 wherein said traffic flow parameter values are updated every time a vehicle passes by said sensor.

40. The system of claim 39 wherein said traffic flow parameter values are integrated over a period of time to generate a time-dependent measure of traffic flow for each said parameter.

41. The system of claim 40 further including use of the fuzzy logic techniques to map said time-of-the-day to a fuzzy time-of-the-day set.

42. The system of claim 41 wherein said fuzzy time-of-the-day set comprises Early Morning, Early Morning Rush, Mid-Morning Rush, Late Morning Rush, Late Morning, Lunch Time, Mid Afternoon, Early Evening, Early Evening Rush, Late Evening Rush, and Late Evening.

43. The system of claim 41 further including the use of fuzzy logic techniques to map said day-of-the-week to a fuzzy day-of-the-week set.

44. The system of claim 43 wherein said fuzzy day-of-the-week set comprises Work Day, Work Day Preceding a Holiday, Holiday and End of Holiday.

45. The system of claim 43 further including the use of a fuzzy rule base to map said degree-of-specialness and said day-of-the-week into said fuzzy day-of-the-week set.

46. The system of claim 40 further including a plurality of learning elements in said method, one for each traffic flow measure, which combine each said traffic flow measure with said time-of-the-day and said day-of-the-week to categorize each said traffic flow measure as Normal or Abnormal.

47. The system of claim 46 wherein said learning element is trained to recognize normal traffic flow.

48. The system of claim 47 wherein said training takes place when said sensor is first placed into service.

49. The system of claim 47 wherein periodic training takes place to accommodate seasonal variations in traffic flow.

50. The system of claim 47 wherein said training takes place in an unsupervised manner.

51. The system of claim 50 wherein said unsupervised training is done using neural network techniques.

52. The system of claim 47 wherein said training results in a plurality of discriminant functions, one for each traffic flow parameter.

53. The system of claim 52 wherein said discriminant functions are fuzzy membership functions.

54. The system of claim 52 further including the combination of the traffic flow parameter value categorizations into a per-lane traffic flow categorization.

55. The system of claim 54 wherein fuzzy logic techniques are used to categorize said lane traffic flow as Normal or Abnormal.

56. The system of claim 54 further including the combination of the per-lane traffic flow categorizations into a road traffic flow categorization.

57. The system of claim 56 wherein fuzzy logic techniques are used to categorize the road traffic flow as Normal, Low Level Anomaly, Severe Anomaly, or Critical Anomaly.

58. The system of claim 22 further including a communication channel over which an indication of abnormal traffic flow is sent to a traffic control center.

59. The system of claim 58 wherein said indication consists of an alarm.

60. The system of claim 59 wherein said alarm is an audible alarm.

61. The system of claim 59 wherein said alarm is a visual alarm.

62. The system of claim 59 further including the transmission of an image of the roadway.

* * * * *